United States Patent [19]

38Havel

[11] Patent Number: 4,684,193

[45] Date of Patent: Aug. 4, 1987

[54] ELECTRICAL ZERO INSERTION FORCE MULTICONNECTOR

[76] Inventor: Karel 38Havel, P.O. Box 66, Station M, Toronto, Ontario, Canada, M6S 4T2

[21] Appl. No.: 894,667

[22] Filed: Aug. 8, 1986

[51] Int. Cl.[4] ..... H01R 13/62

[52] U.S. Cl. ..... 439/259; 439/682

[58] Field of Search ..... 339/74 R, 75 M, 75 R, 339/176 M

[56] References Cited

U.S. PATENT DOCUMENTS

| | | | |
|---|---|---|---|
| 3,094,365 | 6/1963 | Chamberlain et al. | 339/75 R |
| 3,122,408 | 2/1964 | Laszczewski | 339/75 R |
| 3,538,486 | 11/1970 | Shlesinger, Jr. | 339/74 R |
| 3,763,459 | 10/1973 | Millis | 339/75 M |
| 4,422,703 | 12/1983 | Christensen et al. | 339/74 R |

OTHER PUBLICATIONS

IBM Technical Disclosure Bulletin, vol. 22, No. 5, Oct. 1979 "Zero Insertion Force Module Socket", Williams.

*Primary Examiner*—John McQuade

[57] ABSTRACT

An electrical multiconnector of a zero insertion force type comprises a plurality of elongated conducting connector elements extending from an insulating base in generally parallel relation and adapted to be engaged with conducting pins of a mating connector assembly to establish electrical paths therebetween. Each connector element includes a slider arranged thereon for longitudinal movement therealong to its engaging position and away from its engaging position. An actuator plate is provided for reciprocal movement in a direction parallel to the direction of elongation of the connector elements between a disengagement position, to allow the sliders to disengage the connector elements whereby the pins may be inserted or withdrawn without the necessity to exert any force, and an engagement position, to urge the sliders to conductively engage the connector elements with respective pins.

9 Claims, 10 Drawing Figures

ELECTRICAL ZERO INSERTION FORCE MULTICONNECTOR

BACKGROUND OF THE INVENTION

1. Field of the Invention

This invention relates to electrical multiconnectors of a zero insertion force type.

2. Description of the Prior Art

A socket for making temporary electrical connections between a plurality of leads on a semiconductor device described in U.S. Pat. No. 3,763,459, issued on Oct. 2, 1973 to Edwin G. Millis, utilizes pairs of spaced resilient contacts which are actuated by two actuating members simultaneously movable by a crank and shaft mechanism, transversely to the direction of elongation of the leads, to bring the contacts into gripping engagement with the edges of respective leads on the device.

This approach has proved generally satisfactory for dual-in-line semiconductor devices. However, the effective contact area between the pair of resilient contacts and edges of the lead gripped therebetween is relatively small, thereby constraining current flow and contributing to development of unstable voltage drops thereacross.

SUMMARY OF THE INVENTION

Accordingly, it is the principal object of this invention to provide an improved electrical zero insertion force multiconnector which includes a plurality of separate high quality contacts each capable of handling relatively high current flow and exhibiting low and consistent voltage drop.

In accordance with the teaching of the invention, each connector contact is formed between a substantially conventional connector pin and a novel tubular connector element having at its end four integral resilient jaws extending at an angle which may be deflected into intimate electrical contact with the mating pin by a movable slider. Upon engagement, each pin is confined in its mating connector element among the contacting surfaces on the jaws, which are formed to closely conform to the outer surface of the mating pin, for establishing a reliable electrical path along a relatively large contacting area. By applying gripping forces to four opposite sides of the pin, a consistent contact force is maintained which provides optimum conductivity.

The invention resides in the provision of an actuator plate which is operative in its engagement position to simultaneously urge sliders on all connector elements to their engaging positions and in its disengagement position to allow the sliders to drop away from their engaging positions.

Further objects of the invention will become obvious from the accompanying drawings and their description.

BRIEF DESCRIPTION OF THE DRAWINGS

In the drawings in which is shown the preferred embodiment of the invention.

Throughout the drawings, like characters indicate like parts.

DESCRIPTION OF THE PREFERRED EMBODIMENT

Figure 2:
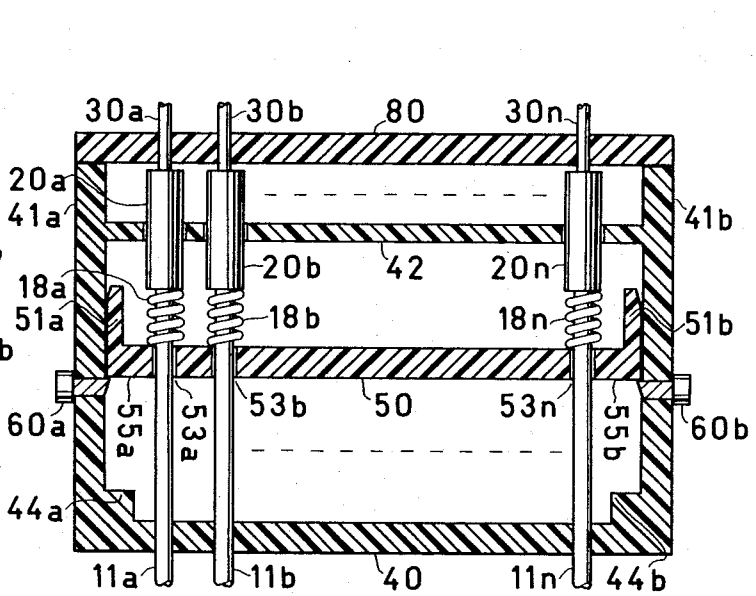
FIG. 2 is a cross-sectional view of a multiconnector shown in FIG. 1 in its engaged condition.
Figure 1:
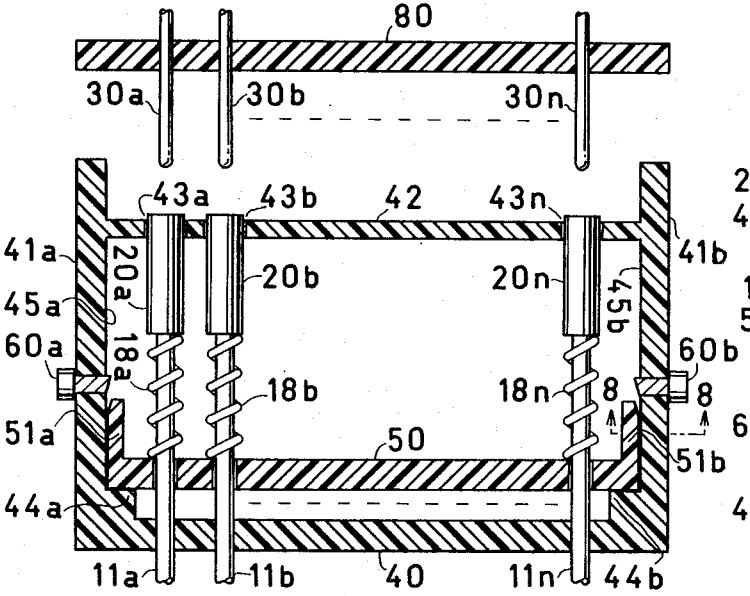
FIG. 1 is a cross-sectional view of a multiconnector of this invention in its disengaged condition.

Referring now, more particularly, to the drawings, in FIGS. 1 and 2 is shown a multiconnector of the invention which includes a male and female assemblies capable of forming a plurality of separate high quality electrical connections when engaged. Generally, the multiconnector has two conditions: engaged one, illustrated in FIG. 2, in which the two assemblies are mechanically secured together and respective connectors pairs are in intimate electrical contact, and disengaged one, illustrated in FIG. 1, in which the male assembly may be inserted into the female assembly or withdrawn therefrom. As will be pointed out subsequently, a single actuator is used to engage and disengage the two assemblies.

The male assembly, which may be of substantially conventional appearance, includes a plurality of spaced apart elongated conducting pins 30*a*, 30*b* to 30*n* extending from an insulating plate 80. The broken line indicates that in reality there may be any suitable number of pins used. Although not specifically illustrated it would be obvious that the pins may be configured in more than one row. The contacting ends of the pins are adapted to engage and make electrical contact with respective connector elements in the female assembly, as will be more fully pointed out subsequently. The other ends of the pins may be provided with suitable terminals for joining conductors thereto (not shown).

The invention resides in the provision of a female assembly which includes a frame, a plurality of female connector elements 11*a*, 11*b* to 11*n* secured therein, equal to the number of male pins, and insulating actuator plate 50 for engaging and disengaging the connector elements. The insulating frame of the female assembly consists of a base 40, a pair of parallel upwardly extending opposed side walls 41*a*, 41*b* secured to the base and having internal flat and smooth surfaces 45*a* 45*b*, respectively, and a top wall 42. Pawls 60*a*, 60*b*, mounted in respective side walls and protruding into the opening therebetween, are adapted to be respectively engaged with the bottom ends of the actuator plate 50, as will be more fully explained subsequently. Elongated conducting connector elements 11 are firmly secured in the base 40, but alternatively may be removable or lockable, and extend therefrom at regular intervals in a parallel spaced relation such that they are substantially aligned with respective pins 30. It would be obvious that the connector elements may be alternatively configured in several rows. Each connector element 11 includes a slider 20 arranged thereon for axial movement therealong which serves to engage the connector element with the aligned pin when in its engaging position and disengage same when sufficiently away from its engaging position. The sliders 20*a*, 20*b* to 20*n* may pass through the top wall 42 by respective apertures 43*a*, 43*b* to 43*n*.

All sliders are simultaneously activated by movement of the actuator plate 50 extending transversely to the direction of elongation of the connector elements and having a plurality of apertures 53*a*, 53*b* to 53*n* formed therethrough within which the connector elements respectively pass. The actuator plate 50 is adapted for reciprocal sliding movement on vertical side walls 41*a*, 41*b* between its disengagement and engagement positions in a direction generally parallel to the direction of elongation of the connector elements. When the actuator plate is in its lower or disengagement position, supported by respective actuator seats 44*a*, 44*b* formed on the base 40, as shown in FIG. 1, the springs 18*a*, 18*b* to 18*n* are relaxed, and respective sliders 20*a*, 20*b* to 20*n* are allowed to drop away from their engaging positions. The actuator plate may be raised, e.g., manually, by sliding its upwardly extending side portions 51*a*, 51*b* on respective smooth surfaces 45*a*, 45*b* of the side walls 41*a*, 41*b*, to its upper or engagement position shown in FIG. 2, wherein it will be lockingly retained by a pawl 60*a* supporting the actuator bottom 55*a* and pawl 60*b* supporting the actuator bottom 55*b*. When the actuator plate is in its engagement position, all springs 18*a*, 18*b* to 18*n* are compressed, thereby urging respective sliders to their engaging positions, as will be more clearly explained subsequently.

It would be obvious to those skilled in the art that lever or power means may be provided for raising the actuator plate to its engagement position. It would be further obvious to provide front and rear walls to completely enclose the female assembly.

Figure 3C:
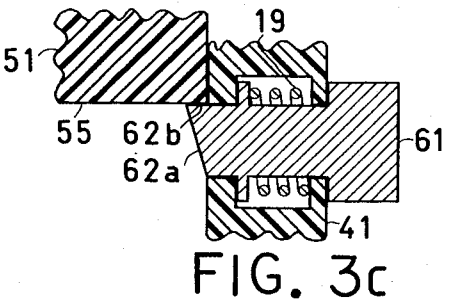
FIG. 3*c* is an enlarged detail of the pawl in its locking position.
Figure 3B:
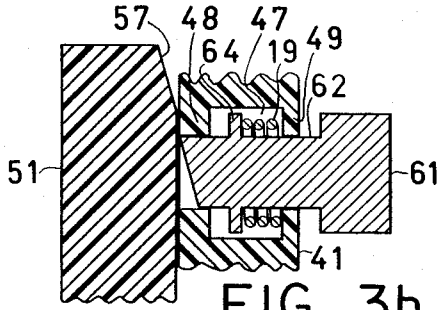
FIG. 3*b* is an enlarged detail of the pawl in its retracted position.
Figure 3A:
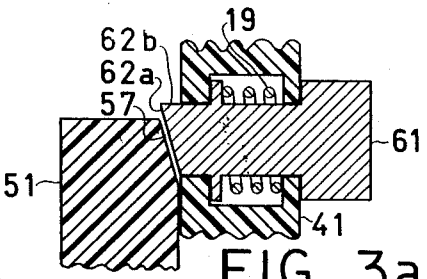
FIG. 3*a* is an enlarged detail of the pawl, shown generally in FIGS. 1 and 2, in its protruding position.

FIGS. 3*a*, 3*b*, and 3*c* show the progress of movement of the actuator plate 50 from its disengagement to engagement position. In FIG. 3*a*, inclined portion 57, formed adjacent the top of the actuator side 51, is approaching complementary shaped inclined portion 62*a* of the pawl 60. Square pawl body 62 is disposed in a pawl cavity 47 formed in the side wall 41 and is normally urged by the force of a pawl spring 19, interposed between the pawl cavity edge 49 and a flange 64 integrally formed on the pawl, to its protruding position wherein pawl head 61 abuts side wall 41, flange 64 abuts the other cavity edge 48, and the top portion 62*b* and inclined portion 62*a* protrude into the space between the side walls 41*a*, 41*b*. While the actuator side moves past the pawl, its inclined portion 57 pushes the pawl 60, against the force of the pawl spring 19, to its retracted position back into the pawl cavity 47, as viewed in FIG. 3*b*. When the actuator side 51 completely passes the pawl 60, the latter moves rapidly back to its protruding position, urged by the pawl spring 19, for lockingly supporting the actuator side, as viewed in FIG. 3*c*, to thereby retain the actuator plate in its engagement position. Although not illustrated, it would be obvious that there may be four pawls employed for respectively lockingly supporting four corners of the actuator plate. It would be also obvious that, alternatively, the pawls may be disposed in the actuator sides.

The heads 61 of the pawls 60*a*, 60*b* may be manually pulled outwardly to release the actuator plate 50 to permit same to drop, by combined forces of compressed springs 18 and gravity, to its disengagement position. It would be obvious to provide a linkabe for simultaneous activation of both pawl heads.

Figure 4:
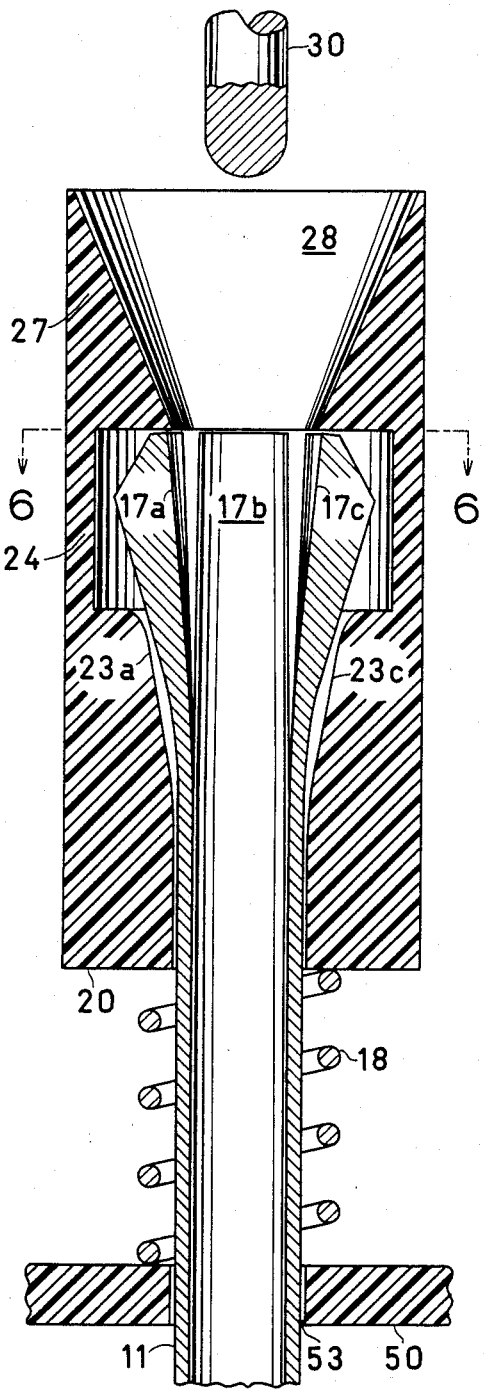
FIG. 4 is an enlarged cross-sectional view of one connector element in its disengaged condition.
Figure 5:
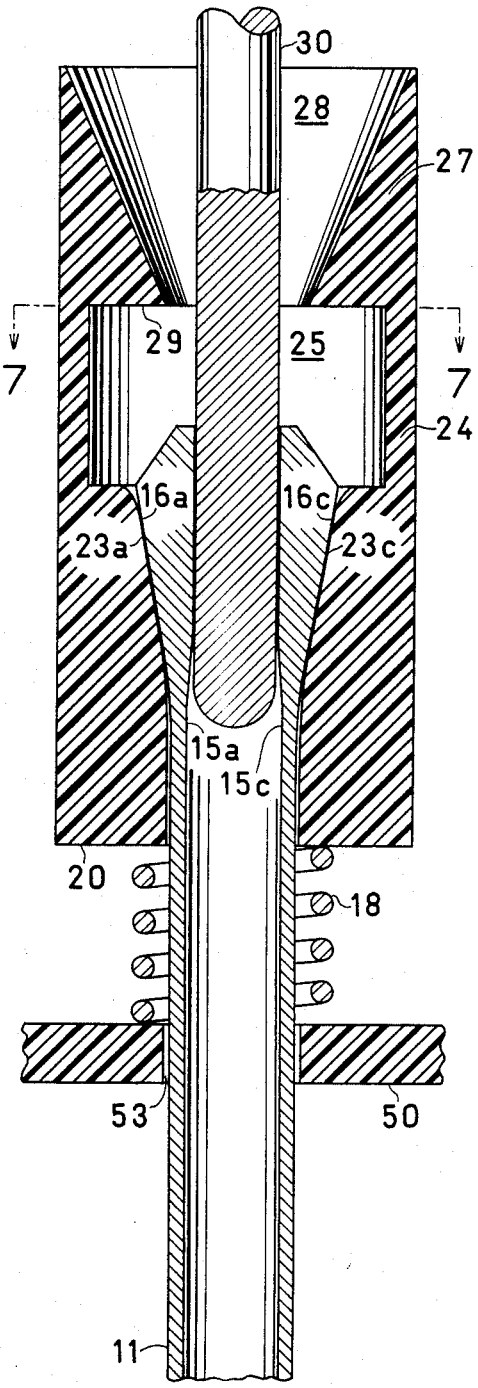
FIG. 5 is an enlarged cross-sectional view of one connector element in its engaged condition.
Figure 6:
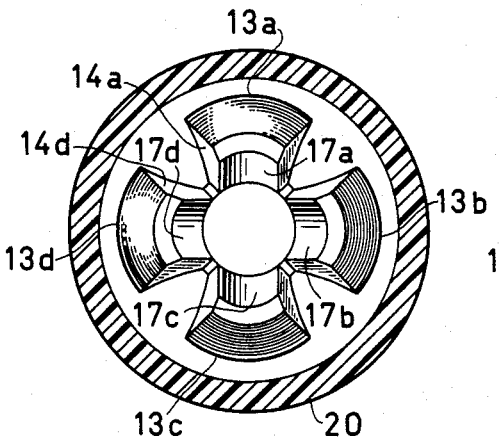
FIG. 6 is a cross-sectional view, taken along the line 6—6 in FIG. 4, of one connector element in its disengaged condition.
Figure 7:
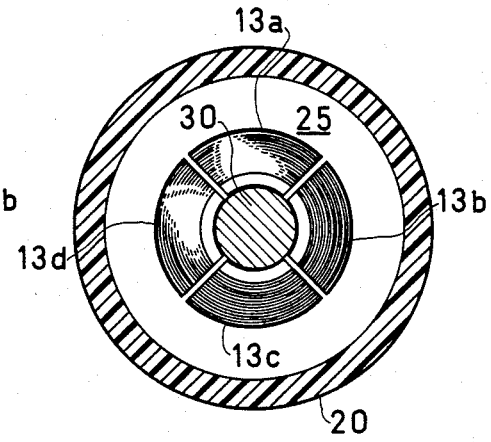
FIG. 7 is a cross-sectional view, taken along the line 7—7 in FIG. 5, of one connector element in its engaged condition.

FIGS. 4 to 7 show various views of one connector element of the multiconnector of the present invention which includes a female connector element 11 adapted to be mated with male element 30. The engaged condition of the two elements is illustrated in FIGS. 5 and 7 and disengaged condition is illustrated in FIGS. 4 and 6. As will be pointed out more specifically below, slider 20 serves to engage and disengage the two elements.

As indicated earlier, the male element 30 is an elongated conducting pin of a circular cross-section. Contacting surfaces are formed thereon adjacent one end of the pin, e.g., by coating with suitable contact materials (not shown). The cross-sectional diameter of the pin should be within certain limits to provide high quality electrical connection. However, it would be obvious to those skilled in the art that pins of other shapes and diameters may be also effectively used.

Elongated female element, extending generally along a vertical longitudinal axis, includes tubular conducting body 11 having at its end four integral symmetrically disposed gripping jaws 13*a*, 13*b*, 13*c*, and 13*d* with resiliently flexible portions 15*a*, 15*b* (not shown but similar to 15*a*), 15*c*, and 15*d* respectively. It is contemplated that there may be any other suitable number of jaws and that the jaws do not need to be symmetrical. The jaws normally extend away from the axis and from one another, as illustrated in FIGS. 4 and 6, so as to form an opening into the female element larger than the diameter of the male pin whereby the latter may be inserted and withdrawn without the necessity to exert any force. The other end of the female element may be adapted for connection to an electrical connector (not shown). Respective jaws have abutting surfaces 16*a*, 16*b* (not shown but similar to 16*a*), 16*c*, and 16*d* (not shown but similar to 16*c*) formed on their outer convex surfaces and contacting surfaces 17*a*, 17*b*, 17*c*, and 17*d* formed on their inner concave surfaces. Each jaw is tapered in thickness such that the thickness of its outer portion uniformly increases towards its middle portion and then decreases again towards its end.

The slider 20, preferably insulating, is arranged on the female element for longitudinal movement along its axis for engaging the jaws when in a position adjacent to the jaw end of the female element, as illustrated in FIG. 5, and for disengaging the jaws when in a position away from the jaw end, as illustrated in FIG. 4. A helical coil spring 18 surrounding the body 11 is anchored at its one end by the actuator plate 50 and has its other end applied to the slider. As a consequence, the slider is urged to its engaging position when the actuator plate is in its upper position. The slider has abutting surfaces 23*a*, 23*b* (not shown but similar to 23*a*), 23*c*, and 23*d* (not shown but similar to 23*c*) sloped at an angle less than 30 degrees with respect to the axis and adapted to engage like abutting surfaces 16*a*, 16*b*, 16*c*, and 16*d* on the jaws to transfer the force of the spring to the jaws and thence to the contacts. When in its engaging position, the slider abuts the jaws, as illustrated in FIG. 5, to deflect same for capturing the male pin and for bringing the contacting surfaces thereon into intimate electrical contact with the contacting surfaces on the jaws. When in its disengaging position, the slider disengages the jaws, as illustrated in FIG. 4, for releasing the male pin. Consequently, to insert or withdraw the entire male assembly, it is necessary to lower the actuator plate 50, as indicated in FIG. 4, to release the force of all springs and allow all sliders to move away from their engaging positions.

The upper portion of the slider contains a wall 27 having inner conical surface defining a funneling entrance 28 for directing the pin, when slightly misaligned, into the connector element. Below the funneling entrance is located a cylindrical wall 24 having an internal surface defining annular cavity 25 with inwardly extending annular edge 29 defining a ceiling which serves to protect the jaws in their disengaged condition, as viewed in FIG. 4.

The jaws are also provided with abutting surfaces therebetween, shown in FIG. 6 on examples of surfaces 14*a* and 14*d*, which serve to limit the deflection of the jaws when no male pin in inserted, to thereby limit the travel of the slider and prevent it from leaving the connector element. In such a case, the deflected jaws form an opening of a diameter slightly less than that shown in FIG. 7 with the male pin engaged.

As best viewed in FIG. 7, the pin 30 is upon engagement confined among the contacting surfaces 17*a*, 17*b*, 17*c*, 17*d* on respective jaws 13*a*, 13*b*, 13*c*, 13*d*, which are formed to closely conform to the outer surface of the pin, for establishing a reliable electrical path therebetween. A compressive contact is maintained along substantially entire contacting surface of the pin, resulting in a contact area that is proportionally larger. By applying gripping forces of four jaws to four opposite sides of the pin, a consistent contact force is maintained which provides optimum conductivity.

Figure 8:
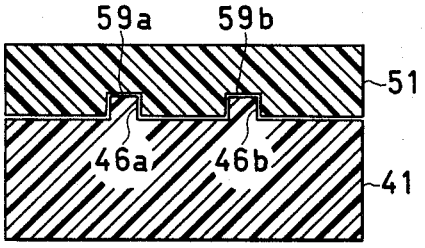
FIG. 8 is an enlarged cross-sectional view, taken along the line 8—8 in FIG. 1, revealing the detail of engagement between the actuator side and side wall surfaces.

FIG. 8 is a detail of an engagement between the side portion of the actuator plate and side wall of the frame. Parallel vertical guiding flanges 46*a*, 46*b*, extending into the space between the side walls, are formed on the side wall 41 and adapted to respectively engage like parallel guiding grooves 59*a*, 59*b* formed in the actuator side 51 whereby the latter may slide up and down, but is prevented from a lateral movement with respect to the walls. Like flanges are formed on the other side wal for engaging like grooves formed in the other actuator side.

In summary, the invention describes an electrical zero insertion force multiconnector comprising an insulating base, a plurality of conduction connector elements extending from the base in generally parallel relation and in an arrangement corresponding to the arrangement of a plurality of conducting pins on a connector assembly to be mated with. Each connector element includes a slider arranged thereon for longitudinal movement therealong to its engaging position and away from its engaging position. An actuator is provided for reciprocal movement in a direction generally parallel to the direction of elongation of the connector elements between a disengagement and engagement position. The actuator is operative is its disengagement position to allow the sliders to move away from their engaging positions such that the connector elements do not engage the pins and in its engagement position to urge the sliders to their engaging positions such that the connector elements are in electrical contact engagement with respective pins.

All matter herein described and illustrated in the accompanying drawings should be interpreted as illustrative and not in a limiting sense. It would be obvious that numerous modifications can be made in the construction of the preferred embodiment shown herein, without departing from the spirit of the invention as defined in the appended claims.

What I claim is:

1. An electrical multiconnector comprising:

an insulating base;

a plurality of conducting connector elements disposed in said base and extending therefrom in generally parallel relation, said connector elements being arranged to correspond to the arrangement of a plurality of conducting pins on a connector assembly to be mated with, each said connector element including a slider member arranged thereon for longitudinal movement therealong to its engaging position and away from its engaging position;

an actuator plate adapted for reciprocal movement in a direction generally parallel to the direction of elongation of said connector elements between a disengagement and engagement positions;

said actuator plate being operative in its disengagement position to allow said slider members to move away from their engaging positions such that said connector elements do not engage said pins; and said actuator plate being operative in its engagement position to urge said slider members to their engaging positions such that said connector elements are in electrical contact engagement with respective said pins.

2. An electrical multiconnector comprising:

an insulating base, a pair of opposed side walls secured to said base and having inner flat and smooth surfaces;

a plurality of elongated conducting connector elements disposed in said base and extending therefrom in generally parallel relations, said connector elements being arranged to correspond to the arrangement of a plurality of conducting pins on a connector assembly to be mated with, each said connector element including a slider member arranged thereon for longitudinal movement therealong to its engaging position and away from its engaging position;

an actuator plate adapted for reciprocal sliding movement along said side walls in a direction generally parallel to the direction of elongation of said connector elements between a disengagement and engagement positions;

said actuator plate being operative in its disengagement position to allow said slider members to move away from their engaging positions such that said connector elements do not engage said pins; and said actuator plate being operative in its engagement position to urge said slider members to their engaging positions such that said connector elements are in electrical contact engagement with respective said pins.

3. An electrical multiconnector as defined in claim 2 more characterized by:

said side walls having a guiding flange formed thereon; and said actuator plate extending transversely to the direction of elongation of said connector elements and including two side portions adapted for sliding movement on respective said side walls, said side portions having a guiding groove formed therein and adapted to engage said flange whereby said actuator plate may slide up and down on said side walls, but is prevented from a lateral movement with respect to said side walls.

4. An electrical multiconnector as defined in claim 2 more characterized by:

locking means for lockingly retaining said actuator plate in its engagement position.

5. An electrical multiconnector as defined in claim 2 more characterized by:

a plurality of resilient means adapted to be applied to respective said slider members for urging same to their engaging positions;

said actuator plate being operative in its disengagement position not to apply said resilient means for allowing said slider members to move away from their engaging positions; and said actuator plate being operative in its engagement position to apply said resilient means for urging said slider members to their engaging positions.

6. An electrical multiconnector as defined in claim 2 more characterized by:

an insulating top wall being secured to said side walls, said top wall having a plurality of apertures formed therethrough wherein said slider members may respectively pass.

7. An electrical multiconnector comprising:

an insulating base;

a plurality of elongated conducting connector elements disposed in said base and extending therefrom in generally parallel relation, said connector elements being arranged to correspond to the arrangement of a plurality of conducting pins on a connector assembly to be mated with, each said connector element including a slider member arranged thereon for longitudinal movement therealong to its engaging position and away from its engaging position;

a plurality of resilient means respectively applied to said slider members for urging them to their engaging positions;

an actuator plate adapted for reciprocal movement in a direction generally parallel to the direction of elongation of said connector elements between a disengagement and engagement positions;

said actuator plate being operative in its disengagement position not to apply said resilient means for allowing said slider members to move away from their engaging positions; and said actuator plate being operative in its engagement position to apply said resilient means for urging said slider members to their engaging positions.

8. An electrical multiconnector comprising:

an insulating base, a pair of opposed side walls secured to said base and having inner flat and smooth surfaces;

a plurality of elongated conducting connector elements disposed in said base and extending therefrom in generally parallel relation, said connector elements being arranged to correspond to the arrangement of a plurality of conducting pins on a connector assembly to be mated with, each said connector element including a slider member arranged thereon for longitudinal movement therealong to its engaging position and away from its engaging position;

a plurality of resilient springs respectively applied to said slider members for urging them to their engaging positions;

an actuator plate adapted for reciprocal sliding movement along said side walls in a direction generally parallel to the direction of elongation of said connector elements between a disengagement and engagement positions;

said actuator plate being operative in its disengagement position to relax said resilient springs for allowing said slider members to move away from their engaging positions; and said actuator plate being operative in its engagement position to compress said resilient springs for urging said slider members to their engaging positions.

9. An electrical multiconnector comprising:

an insulating base, a pair of opposed side walls secured to said base and having inner flat and smooth surfaces;

a plurality of elongated conducting connector elements disposed in said base and extending therefrom in generally parallel relation, said connector elements being arranged to correspond to the arrangement of a plurality of conducting pins on a connector assembly to be mated with, each said connector element including a slider member arranged thereon for longitudinal movement therealong to its engaging position and away from its engaging position;

an actuator plate including two actuator sides adapted for reciprocal sliding movememt along said side walls in a direction generally parallel to the direction of elongation of said connector elements between a disengagement and engagement positions, each said actuator side having an inclined portion fromed adjacent its top;

said actuator plate being operative in its disengagement position to allow said slider members to move away from their engaging positions such that said connector elements do not engage said pins;

said actuator plate being operative in its engagement position to urge said slider members to their engaging positions such that said connector elements are in electrical contact engagement with respective said pins;

two pawls for lockingly retaining said actuator plate in its engagement position, each said pawl being disposed within a cavity formed in one of said side walls and being movable between a protruding position wherein an inclined portion of its body, shaped complementary to said inclined portion of said actuator side, protrudes into the space between said side walls and a retracted position wherein the pawl body is located within said cavity;

two resilient springs for normally respectively urging said pawls to their protruding positions;

whereby said actuator sides push said pawls to their retracted positions while moving past said pawls, and, when said actuator sides pass said pawls, the latter move rapidly back to their protruding positions for lockingly supporting said actuator sides to thereby retain said actuator plate in its engagement position.

* * * * *

UNITED STATES PATENT AND TRADEMARK OFFICE

CERTIFICATE OF CORRECTION

PATENT NO. : 4,684,193

DATED : Aug. 4, 1987

INVENTOR(S) : Karel Havel

It is certified that error appears in the above-identified patent and that said Letters Patent is hereby corrected as shown below:

On the title page, under item [19] and in item [76], "38Havel" should read --Havel--.

Collumn 1, lines 43 and 44, delete "confrom" and insert --conform--.

Column 4, line 3, delete "linkabe" and insert --linkage--.

Column 5, line 42, delete "wal" and insert --wall--.

Column 5, line 46, delete "conduction" and insert --conducting--.

Signed and Sealed this

Twenty-first Day of April, 1992

*Attest:*

HARRY F. MANBECK, JR.

*Attesting Officer*

*Commissioner of Patents and Trademarks*